US006412711B1

(12) United States Patent
Fan

(10) Patent No.: US 6,412,711 B1
(45) Date of Patent: Jul. 2, 2002

(54) ADJUSTABLE SHOWER HEAD

(76) Inventor: Chen-Yueh Fan, Room F/23, 4th Fl., No. 5, Sec. 5, Hsinyi Rd., Taipei (TW)

( * ) Notice: Subject to any disclaimer, the term of this patent is extended or adjusted under 35 U.S.C. 154(b) by 0 days.

(21) Appl. No.: 09/781,337

(22) Filed: Feb. 12, 2001

(51) Int. Cl.[7] ..... A62C 31/00

(52) U.S. Cl. ..... 239/446; 239/558; 239/560; 239/562

(58) Field of Search ..... 239/436, 443, 239/444, 446, 448, 449, 390, 391, 525, 530, 548, 556, 558, 560, 562, 563, 381

(56) References Cited

U.S. PATENT DOCUMENTS 3,963,179 A * 6/1976 Tomaro ..... 239/101
4,398,669 A * 8/1983 Fienhold ..... 239/447
5,213,267 A * 5/1993 Heimann et al. ..... 239/446
5,433,384 A * 7/1995 Chan et al. ..... 239/239
6,076,743 A * 6/2000 Fan ..... 239/381
6,230,989 B1 * 5/2001 Haverstraw et al. ..... 239/443
2002/0003175 A1 * 1/2002 Fan ..... 239/548

* cited by examiner

*Primary Examiner*—Lesley D. Morris
(74) *Attorney, Agent, or Firm*—Hedman & Costigan, P.C

(57) ABSTRACT

An adjustable shower head has a nozzle assembly and a controlling device fitted in a hollow body portion. A knob operably fitted in the base is partially extended out of the base and the body portion. A driving gear carried by the knob is mated with a driven gear integrally formed around the rotary sleeve. The knob can be turned easily as the rotary sleeve is driven by the driving gear to turn around the rear end portion of the base, and the multiple holes and entrances of the rotary sleeve sequentially communicate with the plurality of passages. Therefore water is delivered from the body portion to the nozzle plate via the chambers and passages to give different spray types of shower water.

6 Claims, 7 Drawing Sheets

ADJUSTABLE SHOWER HEAD

BACKGROUND OF THE INVENTION

1. Field of the Invention

The present invention relates to an adjustable showerhead, which enables a user to hold the shower head with one hand and simultaneously operate a controlling knob of the shower head with the same hand to change a spray mode of water.

2. Description of Related Art

A shower head is a fixture for directing the spray of water in a bathroom shower. Cool water and hot water are mixed and then delivered to a nozzle plate of the shower head. The nozzle plate of the shower head is generally designed with different types of nozzles, so as to give different spray modes of shower water. Most of the shower heads sold on the market are adjustable to facilitate users to select different spray modes of water. A conventional adjustable shower head normally has an adjusting device provided near the nozzle plate thereof. When a user takes a shower with the conventional adjustable shower head and wants change the spray mode of water, the shower head must be held in one hand and the adjusting device is then turned with the other hand. The defect of the conventional adjustable shower head is that the user can not hold the shower head with one hand and simultaneously operate the adjusting device with the same hand.

Therefore, it is an objective of the invention to provide an improved adjustable shower head to mitigate and/or obviate the aforementioned problems.

SUMMARY OF THE INVENTION

The object of the present invention is to provide an adjustable shower head having a nozzle assembly and a controlling device fitted in a hollow body portion. The nozzle assembly comprises a base fixed in the body portion, a nozzle plate fixedly enclosing a front opening end of the body portion, and an orifice plate provided between the nozzle plate and the base. The base has a plurality of chambers defined in a front end portion thereof, a plurality of passages defined in a rear end portion thereof and respectively communicating with the plurality of chambers, and a rotary sleeve rotatably mounted around the rear end portion. The controlling device comprises a knob operably fitted in a receiving recess of the base and partially extended out of the base and the body portion, and a driving gear mated with a driven gear integrally formed around the rotary sleeve and carried by the knob via a spindle. When a user holds the shower head with one hand, the knob can be easily operated with only one finger of the same hand. Then the rotary sleeve is driven to turn around the rear end portion of the base. Multiple holes and entrances respectively defined in a closed end face and a side wall of the rotary sleeve are sequentially communicated with the plurality of passages. Therefore, the body portion is sequentially communicated with the plurality of the chambers via the corresponding passages, and then water is delivered from the body portion to the nozzle plate via the passages and the chambers to give different spray types of shower water.

The detailed features of the present invention will be apparent in the detailed description with appropriate reference to the accompanying drawings.

DETAILED DESCRIPTION OF THE PREFERRED EMBODIMENT

Figure 1:
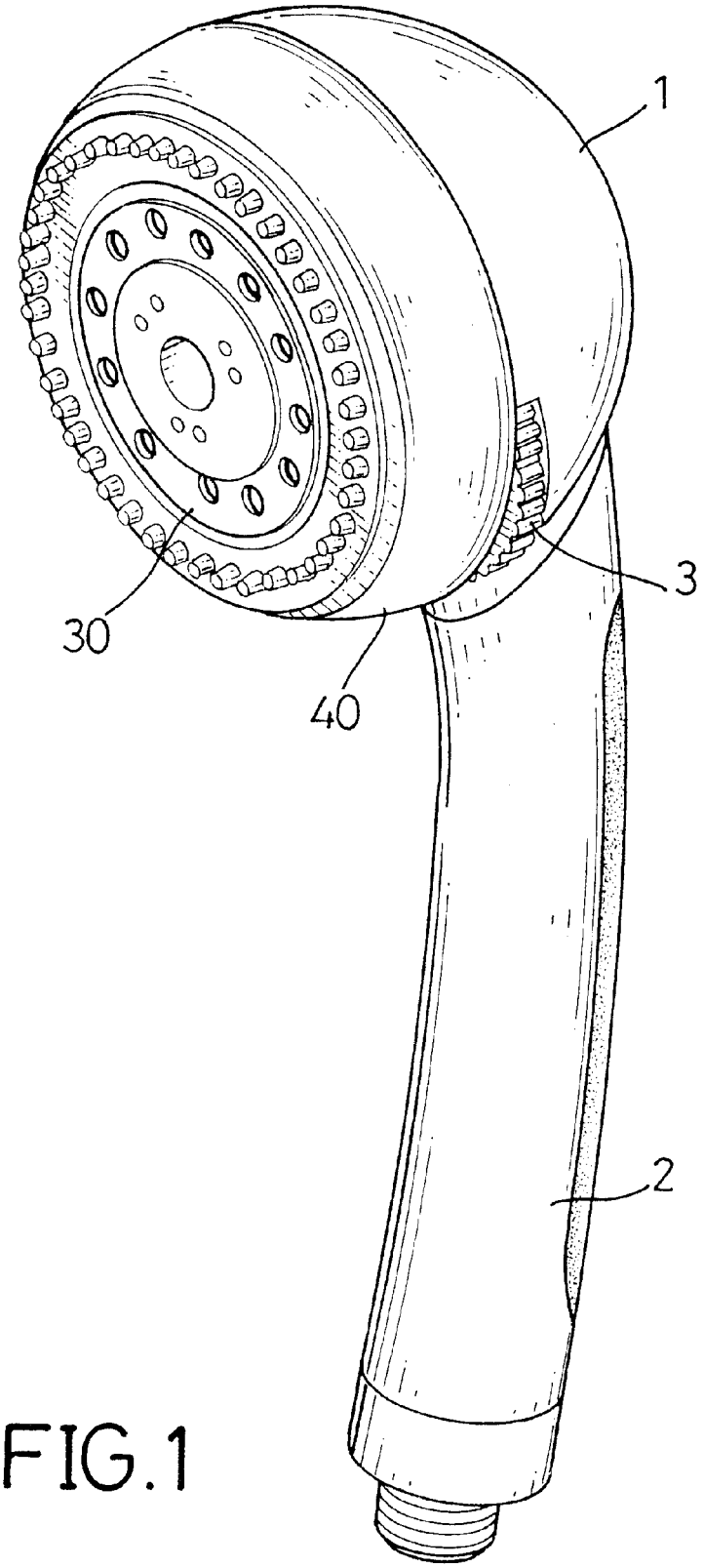
FIG. 1 is a perspective view of an adjustable shower head in accordance with the present invention.

As shown in FIG. 1, the present invention relates to an adjustable shower head, which comprises a hollow body portion (1), a hollow handle portion (2) integrally formed with the body portion (1), a nozzle assembly and a controlling device respectively fitted in the body portion (1).

Figure 2:
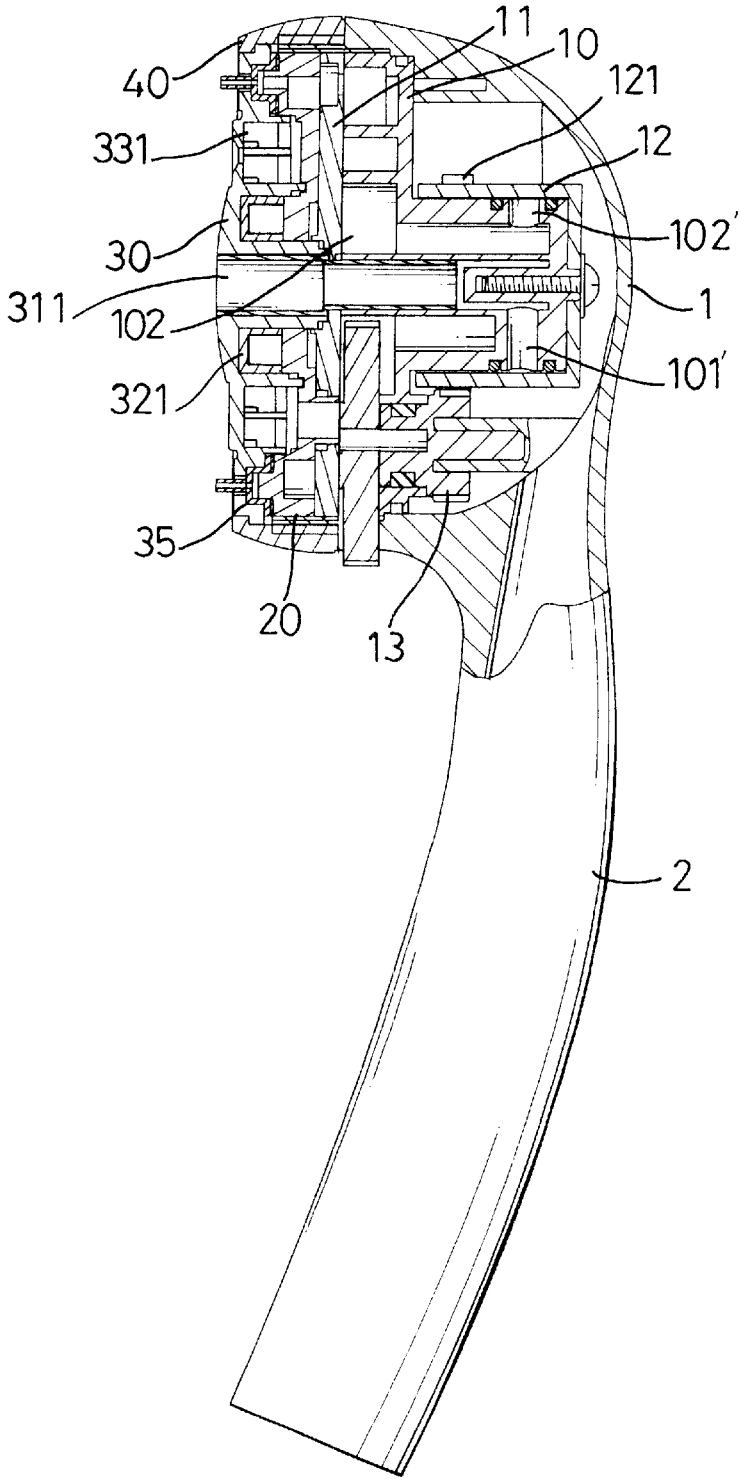
FIG. 2 is a cross sectional view of the adjustable shower head in accordance with the present invention.
Figure 3:
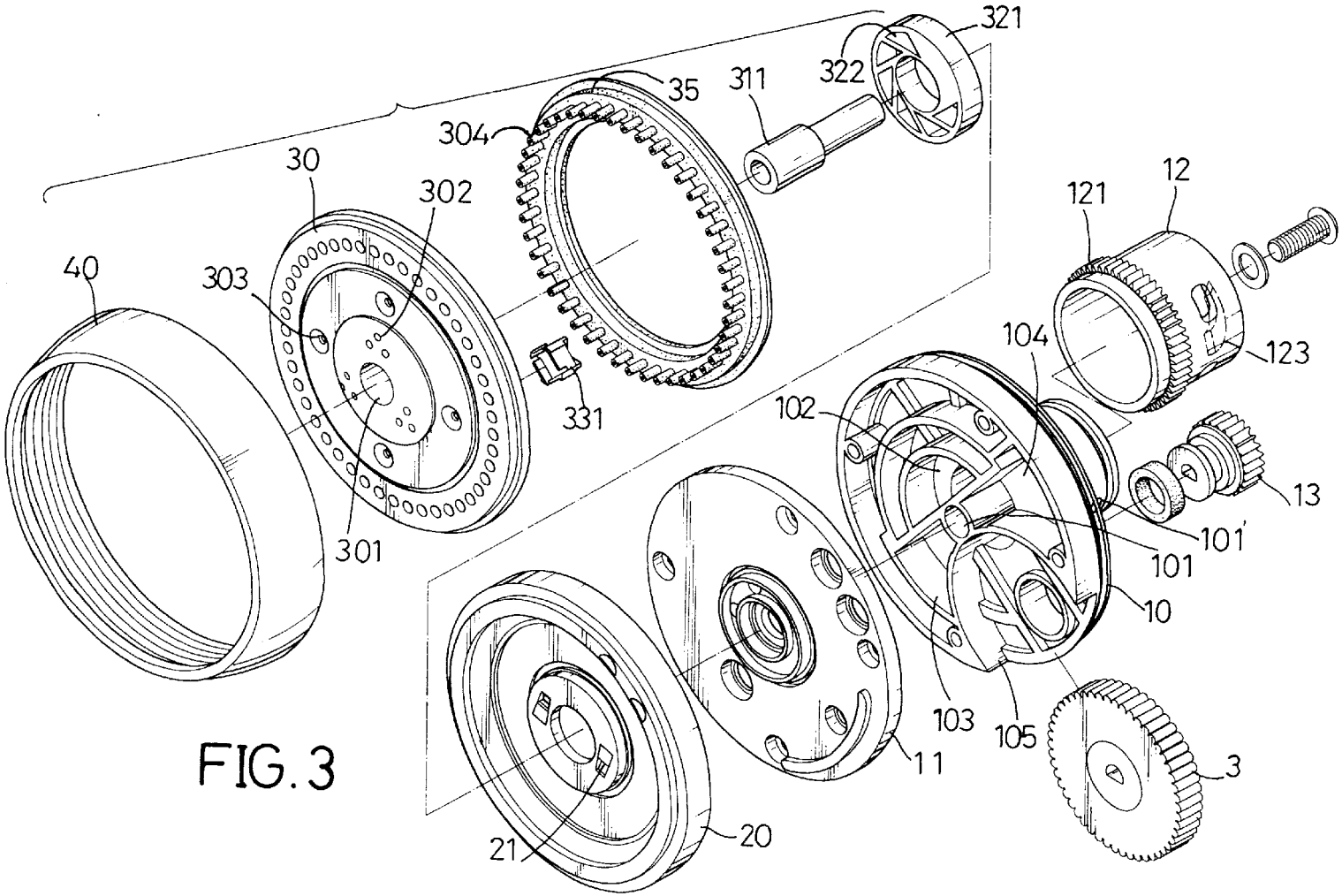
FIG. 3 is an exploded perspective view of the adjustable shower head in accordance with the present invention.
Figure 4:
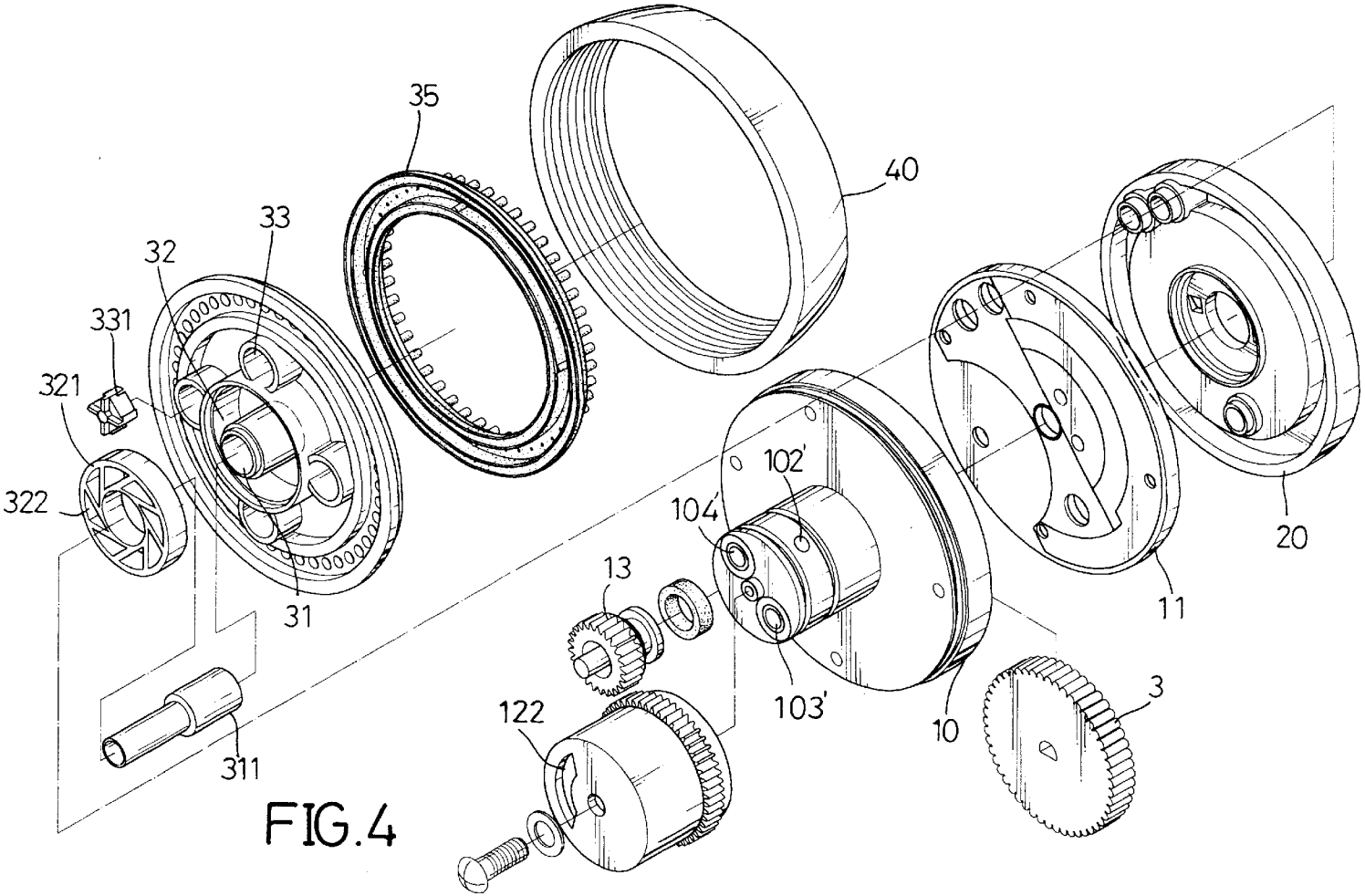
FIG. 4 is an exploded perspective view in an inverted direction of the adjustable shower head in accordance with the present invention.

With reference to FIGS. 2, 3 and 4, the nozzle assembly comprises a base (10) fixed in the body portion (1), and an orifice plate (20) provided between the base (10) and a nozzle plate (30), which is fixedly enclosed in a fixing hoop (40) threadingly engaged on a front opening end of the body portion (1). The base (10) has a front end portion with a cover plate (11) securely mounted on a front end face thereof, and a rear end portion with a rotary sleeve (12) rotatably mounted therearound. The controlling device includes a knob (3) partially received in one side of the base (10), a driving gear (13) carried by the knob (3) and mated with a driven gear (121) integrally formed around the rotary sleeve (12).

Figure 7:
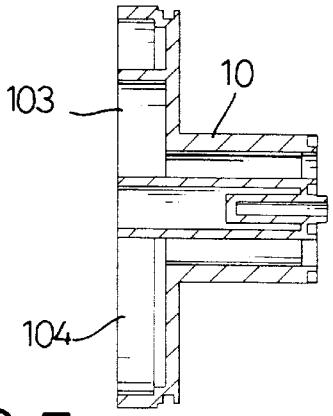
FIGS. 6 and 7 are cross sectional views of the base of the adjustable shower head in accordance with the present invention.
Figure 6:
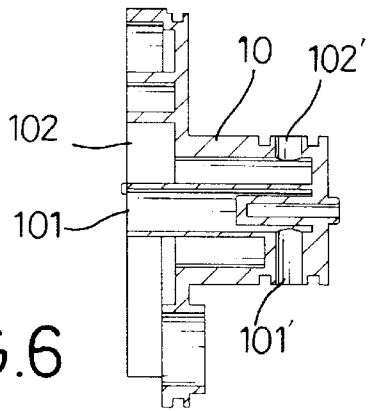
Figure 5:
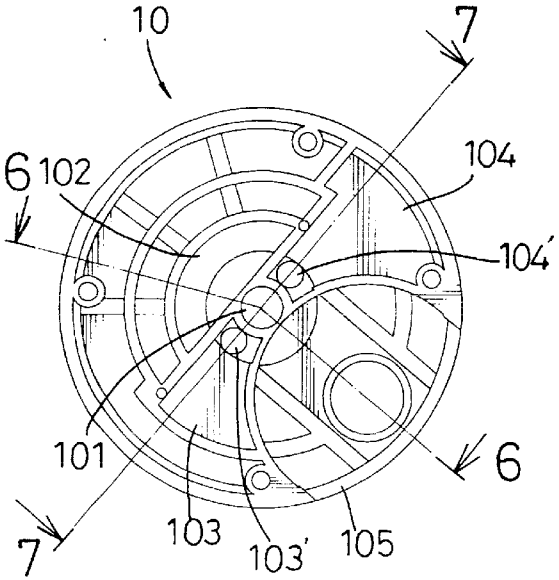
FIG. 5 is a plan view of a base of the adjustable shower head in accordance with the present invention.

As clearly shown in FIG. 5, the front end face of the front end portion of the base (10) has a first chamber (101) defined in a center thereof, and a second, a third and a fourth chamber (102, 103, 104) respectively defined therein and distributed around the first chamber (101). A receiving recess (105) having a side opening is defined at one side of the front end portion of the base (10). As shown in FIG. 6, the rear end portion of the base (10) has a first and a second passage (101', 102') respectively defined in a side wall thereof and respectively in communication with the first and the second chambers (101, 102). With reference to FIGS. 5 and 7, a third and a fourth passage (103', 104') are respectively defined in a rear end face of the rear end portion and respectively in communication with the third and the fourth chambers (103, 104).

Figure 8:
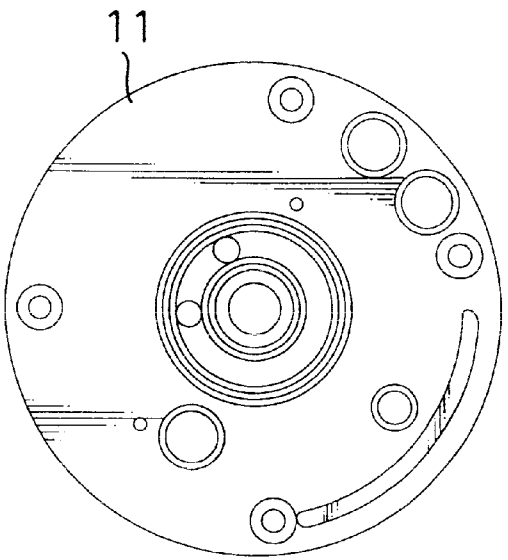
FIG. 8 is a plan view of a cover plate of the base of the adjustable shower head in accordance with the present invention.
Figure 9:
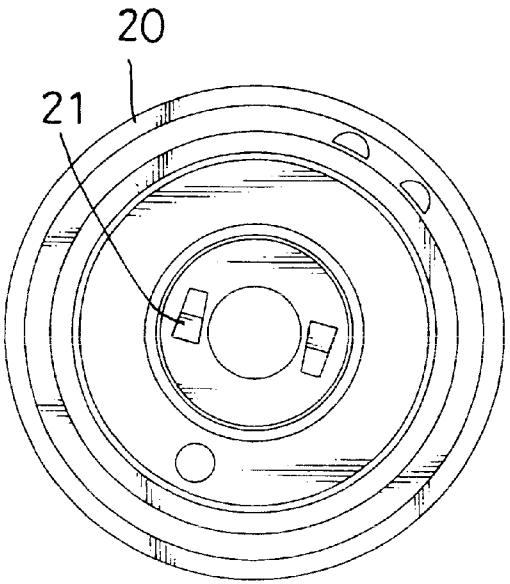
FIG. 9 is a plan view of an orifice plate of the adjustable shower head in accordance with the present invention.

FIG. 8 shows that the cover plate (11) is defined with a plurality of apertures respectively corresponding to the first, second, third and fourth chambers (101, 102, 103, 104). As shown in FIG. 9, the orifice plate (20) is defined with multiple through holes respectively in communication with the first, third and fourth chambers (101, 103, 104), and is particularly defined with multiple inclined through holes (21) in communication with the second chamber (102).

Now with reference to the FIGS. 2, 3 and 4, a bolt extends through a central hole defined in a closed end of the rotary sleeve (12) and threadingly engages with a thread hole defined in a center of the rear end portion of the base (10), whereby the rotary sleeve (12) is rotatably mounted around the rear end portion of the nozzle base (10). The rotary sleeve (12) further has multiple holes (122) defined in the closed end thereof, and multiple entrances (123) defined in a sidewall thereof. The knob (3) is operably fitted in the receiving recess (105) and partially extended outward through the side opening of the receiving recess (105) and extended out of the base (10) and the body portion (1), so that a user holding the shower head in one hand can easily operate the knob (3) with one finger of the same hand. The driving gear (13) mated with the driven gear (121) is carried by the knob (3) via a spindle (which is not shown in drawings) co-axially connected with the knob (3) and the driving gear (13). When the user turns the knob (3), the driving gear (13) drives the rotary sleeve (12) to turn around the rear end portion of the base (10). The multiple holes (122) and multiple entrances (123) of the rotary sleeve (12) are in sequential communication with the first, second, third and fourth passages (101', 102', 103', 104'). Therefore, the body portion (1) is sequentially communicated with the first, second, third and fourth chambers (101, 102, 103, 104) via the corresponding first, second, third and fourth passages (101', 102', 103', 104').

Figure 12:
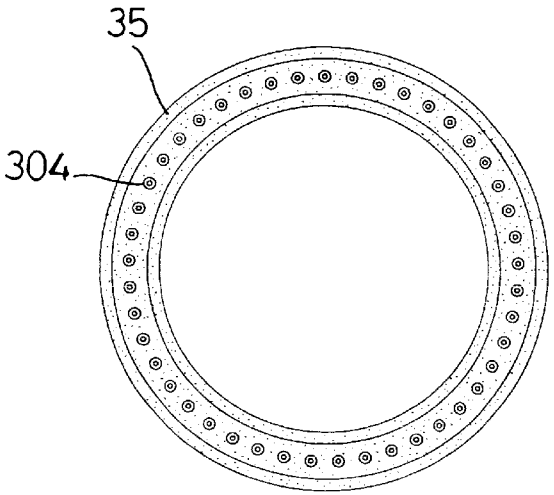
FIG. 12 is a plan view of a nozzle ring of the adjusting shower head in accordance with the present invention.
Figure 11:
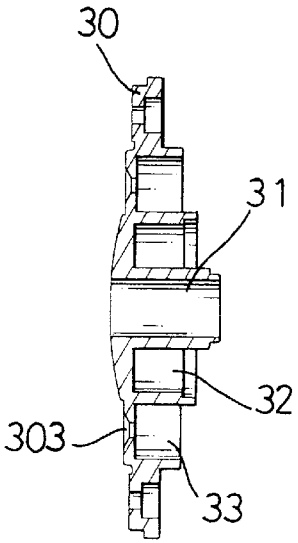
FIG. 11 is a cross sectional view of the nozzle plate of the adjustable shower head in accordance with the present invention.
Figure 10:
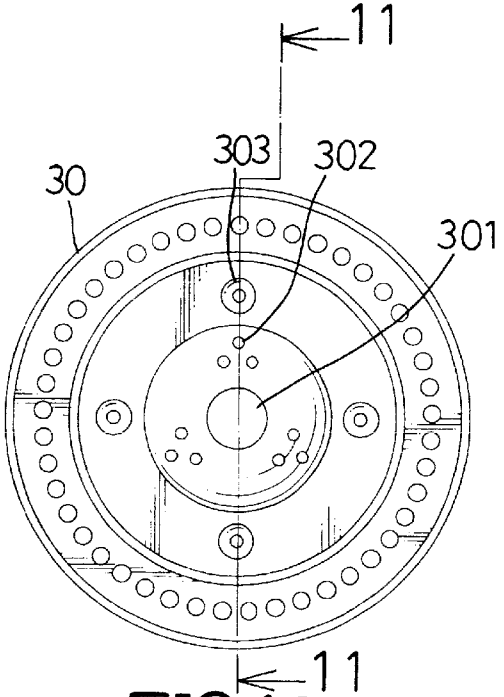
FIG. 10 is a plan view of a nozzle plate of the adjustable shower head in accordance with the present invention.

As shown in FIG. 10, the nozzle plate (30) has a first nozzle (301) defined in a center thereof corresponding to the first chamber (101), multiple sets of second nozzles (302) and a plurality of third nozzles (303) respectively defined therein corresponding to the second and third chambers (102, 103). With reference to FIG. 11, a cross sectional view of the nozzle plate (30) and still taking FIG. 10 for reference, wherein the first nozzle hole (301) is defined by a hollow fixing seat (31) integrally formed on a back side of the nozzle plate (30). The back side of the nozzle plate (30) is further defined with an annular recess (32) enclosing the fixing seat (31), and a plurality of cavities (33) distributed around the annular recess (32). The annular recess (32) and the plurality of the cavities (33) are respectively communicated with the multiple sets of the second nozzle holes (302) and the plurality of the third nozzle holes (303). Referring to FIG. 12, a nozzle ring (35) has a plurality of needle-like fourth nozzles (304) integrally formed and distributed therearound.

Now still with reference to the FIGS. 2, 3 and 4, a step-shaped hollow axle (311) has a first end portion thereof fixedly fitted in the fixing seat (31) and communicating with the first nozzle hole (301), and a second end portion thereof extended through the orifice plate (20) and the cover plate (11) and communicating with the first chamber (101). An annular vane-type swirler (321) having a plurality of slots (322) defined therein by an outer annular wall, an inner annular wall and a plurality of partition walls tangent with the inner annular wall is rotatably fitted in the annular recess (32). The plurality of slots (322) respectively correspond to the inclined through holes (21) of the orifice plate (20). Each of the plurality cavities (33) of the nozzle plate (30) has a nozzle block (331) received therein. The nozzle ring (35) is abutted against the back side of the nozzle plate (30). The fourth nozzles (304) are respectively extended through a plurality of orifices defined through the nozzle plate (30) and are in communication with the fourth chamber (104).

When the user turns the knob (30), the rotary sleeve (12) is driven to rotate around the rear end portion of the base (10). The multiple holes (122) and multiple entrances (123) are sequentially in communication with the first, second, third and fourth passages (101', 102', 103', 104'), so that water is sequentially delivered from the body portion (1) to the first, second, third and fourth chambers (101, 102, 103, 104) via the first, second, third and fourth passages (101', 102', 103', 104'). Water directed from the first, second, third and fourth chambers (101, 102, 103, 104) to the first, second, third and fourth nozzles (301, 302, 303, 304) respectively gives out different spray types of water.

The advantage of the present invention is that the user can hold the shower head with one hand and easily operate the knob (3) with only one finger of the same hand simultaneously to change spray type of water.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An adjustable shower head comprising a hollow body portion (1), a hollow handle portion (2) integrally formed with the body portion (1), a nozzle assembly and a controlling device respectively fitted in the body portion (1); wherein the nozzle assembly comprises a base (10) fixed in the body portion (1), and a nozzle plate (30) fixedly enclosing a front opening end of the body portion (1); wherein the base (10) has a plurality of chambers defined in a front end portion thereof, a plurality of passages defined in a rear end portion thereof and respectively communicating with the plurality of chambers, a receiving recess (105) having a side opening defined at one side of the front end portion thereof, and a rotary sleeve (12) rotatably mounted around the rear end portion thereof, the rotary sleeve (12) is defined with multiple holes (122) in a closed end thereof and multiple entrances (123) in a side wall thereof;

the controlling device includes a knob (3) operably fitted in the receiving recess(105) and partially extended through the side opening of the receiving recess (105) and extended out of the base (10) and the body portion (1), a driving gear (13) mated with a driven gear (121) integrally formed around the rotary sleeve (12) and carried by the knob (3) via a spindle, which is co-axially connected with the knob (3) and the driving gear (13);

whereby when a user holds the shower head in one hand and turns the knob (3) with the same hand, the rotary sleeve (12) is driven by the driving gear (13) to turn around the rear end portion of the base (10), the multiple holes (122) and multiple entrances (123) are sequentially communicated with the plurality of passages, therefore, the body portion (1) is sequentially communicated with the plurality of chambers via the corresponding plurality of passages, water is directed from the body portion (1) to the nozzle plate (30) via the chambers and the passages to give out different spray types of shower water.

2. The adjustable shower head as claimed in claim 1, wherein a cover plate (11) is securely mounted on a front end face of the front end portion of the base (10) and defined with a plurality of apertures respectively corresponding to the plurality of chambers, an orifice plate (20) is provided between the cover plate (11) of the base (10) and the nozzle plate (30) and defined with a plurality of through holes respectively in communication with the plurality of chambers, the nozzle plate (30) is defined with a plurality sets of nozzles respectively in communication with the corresponding plurality of chambers via the corresponding plurality of through holes of the orifice plate (20) and the plurality of apertures of the cover plate (11), each one set of nozzles giving a different spray type of shower water.

3. The adjustable shower head as claimed in claim 2, wherein a first nozzle hole (301) is defined in a center of the nozzle plate (30), a fixing seat (31) defining the first nozzle hole (301) is integrally formed on a back side of the nozzle plate (30), a hollow axle (311) fixedly fitted in the fixing seat (31) has a first end thereof communicating with the nozzle hole (301) and a second end thereof extended through the orifice plate (20) and the cover plate (11) and communicating with a first chamber defined in center of the front end portion of the base (10).

4. The adjustable shower head as claimed in claim 2, wherein the nozzle plate (30) has an annular recess (32) defined in the back side thereof enclosing around the fixing seat (31), and multiple sets of second nozzle holes (302) defined in the nozzle plate (30) and communicating with the annular recess (32),an annular vane-type swirler (321) having a plurality of slots (322) defined therein by an outer annular wall, an inner annular wall and a plurality of partition walls tangent with the inner annular wall is rotatably fitted in the annular recess (32),and the orifice plate (20) is defined with an inclined through hole (21) corresponding to the plurality of slots (322).

5. The adjustable shower head as claimed in claim 2, wherein the nozzle plate (30) has a plurality cavities (33) defined in the back side thereof, and a plurality of third nozzles (303) respectively corresponding to the plurality cavities (33), each one of the cavities (33) has a nozzle block (331) received therein.

6. The adjustable shower head as claimed in claim 2, wherein a nozzle ring (35) is abutted against the back side of the nozzle plate (30), a plurality of needle-like fourth nozzles (304) integrally formed and distributed around the nozzle ring (35) are respectively extended through the nozzle plate (30).

* * * * *